United States Patent [19]

Niskanen

[11] Patent Number: 4,884,943

[45] Date of Patent: Dec. 5, 1989

[54] METHOD AND APPARATUS FOR PUMPING HIGH-CONSISTENCY FIBER SUSPENSION

[75] Inventor: Toivo Niskanen, Hamina, Finland

[73] Assignee: A. Ahlstrom Corporation, Noormarkku, Finland

[21] Appl. No.: 209,634

[22] Filed: Jun. 21, 1988

[30] Foreign Application Priority Data

Jun. 25, 1987 [FI] Finland ..... 872817
Jul. 6, 1987 [FI] Finland ..... 872968

[51] Int. Cl.[4] ..... F04D 1/10
[52] U.S. Cl. ..... 415/143; 415/58.7
[58] Field of Search ..... 415/143, 52, 11, 71, 415/157, 1, 53 R

[56] References Cited

U.S. PATENT DOCUMENTS

| | | | |
|---|---|---|---|
| 2,874,642 | 2/1959 | Forrest | 415/157 |
| 3,059,862 | 10/1962 | Rich | 417/203 |
| 3,070,025 | 12/1962 | Cliborn | 415/11 |
| 3,504,986 | 4/1970 | Jackson | 415/11 |
| 4,149,825 | 4/1979 | Grennan | 415/46 |
| 4,375,937 | 3/1983 | Cooper | 415/53 R |
| 4,375,938 | 3/1983 | Dussourd | 415/53 R |
| 4,410,337 | 10/1983 | Gullichsen et al. | 55/21 |
| 4,435,122 | 3/1984 | Niskanen et al. | 415/121 B |
| 4,435,193 | 3/1984 | Gullichsen et al. | 55/190 |
| 4,531,892 | 7/1985 | Nasman et al. | 415/71 |
| 4,770,604 | 9/1988 | Luthi et al. | 415/143 |
| 4,780,053 | 10/1988 | Gullichsen | 415/143 |

FOREIGN PATENT DOCUMENTS

| | | |
|---|---|---|
| 3038735 | 2/1986 | Fed. Rep. of Germany . |
| 7509953 | 6/1981 | Sweden . |
| 606804 | 11/1978 | Switzerland . |

OTHER PUBLICATIONS

PCT WO84/00741, Mar. 1984.

*Primary Examiner*—Robert E. Garrett
*Assistant Examiner*—John T. Kwon
*Attorney, Agent, or Firm*—Toren, McGeady & Associates

[57] ABSTRACT

A method and an apparatus for treating high-consistency fiber suspension are especially suitable for short distance conveyances of thick fiber suspensions (consistency more than 15%) in pulp and paper industry, for example for discharge of mass towers either with or without any actual pump. The treatment of fiber suspension with a consistency more than 15% is not possible with the known technique without a displacement type of pump, which is expensive and easy to break. Additionally, in discharging of the mass tower, drop leg, etc., fiber suspension causes trouble by arching in the container in such a way that it forms an open chamber around the pump located at the bottom of the container which chamber is slowly filled by fiber suspension. The problems are solved or minimized by arranging a feed apparatus (31) in the pump chamber, which feeds fiber suspension to a fluidizing rotor (21), for fluidizing the fiber suspension, whereafter the suspension flows onwards. The feeder apparatus raises the pressure of the fiber suspension sufficiently for the fluidization, not too high, in which case the operational members would be stressed redundantly. Fiber suspension is fed excessively to the rotor (21), whereby the feeding pressure of fiber suspension is controlled by throttling devices (34) arranged separate from the feeder apparatus in the back-circulation or passage.

10 Claims, 5 Drawing Sheets

METHOD AND APPARATUS FOR PUMPING HIGH-CONSISTENCY FIBER SUSPENSION

The present invention relates to a method of and apparatus for pumping pulp having the consistency of more than 15 per cent. The method and apparatus according to the invention are especially suitable for pumping of fiber suspension in the wood processing industry.

In the treatment of fiber suspensions, in this connection mainly short distance conveyances of pulp, it is well known to convey pulp immediately after the consistency of fiber suspension rises to the middle consistency range (6–15%), by using, instead of centrifugal pumps, screw or gear pumps, which are heavy, large, expensive and easy to break. It is also known to extend the range of use of centrifugal pumps first to the middle consistency range and later also to the high consistency range.

There are a great number of screw conveyers and screw feeders which are used to convey different materials. Common to all of them is the feature that a separate housing, relative to the screw, always surrounds the screw. The housing is usually cylindrical including an opening on one side in the front end for feeding the material to be conveyed to the screw, and an outlet end of the screw is either open or there is an outlet opening for the conveyed material in the housing wall of the screw close to the outlet end. The only differences in the actual screws are to be found in the screw thread or in the shaft. The thread has been either closed, in other words uniform without any openings between the thread and the shaft, or partly open with lead members arranged between the thread and the shaft. Additionally, the screw pitch can, of course, vary, as, for example, in the screws used as thickeners, in which screws the pitch decreases constantly from the front end towards the rear end of the screw. The only differences in the shaft are due to the form of the shaft, whether it is a uniform, round bar or a tapering, cylindrical element. Shafts of the last mentioned type are used, e.g. in press screws, having the purpose of a constant reduction of the open volume, the result of which is thickening of material and, for example, precipitation of aqueous material. The majority of the available screw conveyers and feeders are manufactured by combining above-mentioned characteristics.

In some cases toothing is added on the outer edge of the screw thread, by means of which it is easier to tear material with the screw, for example, when aiming to convey fiber suspensions of pulp and paper industry, which in high consistencies form a durable fiber network, of which very little can be conveyed by a conventional screw.

Screw conveyers do not intentionally cause a rise in pressure of the material to be fed, but the slight rise in the pressure is due to the friction between the material and the housing. Thus the material being fed by a conventional screw conveyer is discharged with the same pressure as it was fed. If the intention is to let the screw raise the pressure of the material being fed as it should be when the screw is used to feed, for example, a centrifugal pump, the simplest and most well-known way is to feed more material than the centrifugal pump can treat. The pressure thus rises and the excessively fed material returns to the circulation either along the inner surface of the screw housing or, in the case of a partly open screw, via the opening between the thread and the shaft.

It has, however, been noted that it is not possible to apply a completely automatic control of feed pressure, as disclosed e.g. in U.S. Pat. No. 3,504,986, to pumping of high consistency fiber suspension, because pulp with consistency of more than 15%, does not move under pressure via thin ducts in the required way of the arrangement of the U.S. patent. Thus the only possibilities are either to control the pressure entirely from the outside of the apparatus or to arranage the pressure controlling apparatus stationary, whereby it is actually not possible to adjust the pressure. In the last mentioned case it must be assumed that the pulp to be pumped is extremely homogeneous, in other words the consistency should not vary much of the expected value, according to which value the throttling of the feeding apparatus is originally defined.

In some cases, e.g. when the material to be pumped is high consistency fiber suspension and is being pumped from the mass tower, it is difficult to feed the pulp from the mass tower with a conventional screw conveyer unless the diameter of the screw feeder is enlarged almost to the size of the diameter of the mass tower, because it is necessary to provide a housing for the screw feeder or conveyer, along which housing the material is fed and the high consistency pulp does not flow through the inlet opening with a small diameter to the screw.

Following examples of the prior art can be mentioned as representatives of different trends in the middle consistency range: a typical representative of a conservative trend is an arrangement according to U.S. Pat. No. 3,059,862, in which it has already been necessary in these consistencies to combine a screw pump on the suction side of a gear pump operating as the actual pump to feed fiber suspension directly to the suction opening of the gear pump.

Representatives of more modern, constantly developing trends are, e.g. arrangements according to U.S. Pat. Nos. 4,435,122; 4,410,337 and 4,435,193. In all said arrangements pulp is pumped with a centrifugal pump, onto the suction opening of which is mounted a rotor for fluidizing fiber suspension.

As a third example of the arrangements according to the prior art an equipment according to U.S. Pat. No. 4,531,892 is disclosed for pumping fiber suspension which comprises a centrifugal pump to which pulp is fed in a known way with a screw pump. The thread of the screw pump is partly open from the inside and thus some of the fiber suspension circulates back against the actual feeding direction. Furthermore, it is characteristic of the arrangement according to the patent publication that the screw rotates against the rotational direction of the pump impeller and also with less speed. If the described arrangement is used the back-circulation becomes very high as well as the stress in the screw. Additionally, the impeller of a conventional centrifugal pump described in the patent specification does not very effectively tear off the pulp plug which is slowly pressed against it by the screw feeder. The higher the consistency becomes, the more poorly the pump operates and the greater the stress against the whole equipment becomes.

When tending to pump suspension of high consistency with a centrifugal pump it is advantageous to feed pulp towards the pump, fluidize the suspension and pump it. Fiber suspension, e.g. middle-consistency pulp, can be fed with a screw feeder according to the prior art. Pumping and partly also fluidization is carried out according to the prior art. If a standard screw feeder is used, which pushes the pulp plug towards the fluidizing rotor, a risk of clogging the feeding equipment arises. It is also in some cases reasonable to tend to use a standard fluidizing centrifugal pump, whereby it is advantageous to arrange the additional equipment required by high-consistency suspension in communication with the feeder apparatus and completely apart from the pump. Further, it is important in many cases to be able to control the operation of the pump in some way, mainly by feed pressure and volumetric flow, especially if the consistency of the fiber suspension to be pumped varies. For the control of feed pressure a reference is made to the options described above.

In order to realize the aims introduced above a method has been developed which is characterized in that the back-circulation of the additional fiber suspension is constricted and thus the feed pressure of the fiber suspension is controlled.

To carry out the described method an apparatus according to the invention is developed, characterized in that a throttling equipment of throttle device is mounted separate from the feed apparatus in the back-circulation duct of passage of the additional fiber suspension.

An arrangement according to a preferred embodiment of the invention is further characterized in that a closing member is arranged on part of the outer edge of the thread of the screw feeder apparatus, which at least partially closes the thread in the radial direction.

A screw conveyer/screw feeder according to the invention has the advantage that the screw does not need a separate housing. For example, when discharging the mass tower or like vessel a screw with a great diameter is not necessary, but it is sufficient to locate the outwards open part of the actual screw of the screw feeder apparatus at the bottom of the mass tower. The thread then ensures that fiber suspension flows to the desired direction. At the same time the apparatus according to the invention enables, for example, the connection of the pump directly to the wall of the mass tower, because the suction pressure needed by the pump can be developed in the actual screw without any need to arrange a separate stationary housing of the screw feeder to raise the pressure. Thus a screw feeder apparatus according to the invention is very inexpensive and a simple arrangement is achieved compared with the conventional screw feeders, while all the redundant and additional elements have been eliminated or minimized.

The invention is described below in detail, by way of example, with reference to the accompanying drawings, in which.

Figure 1:
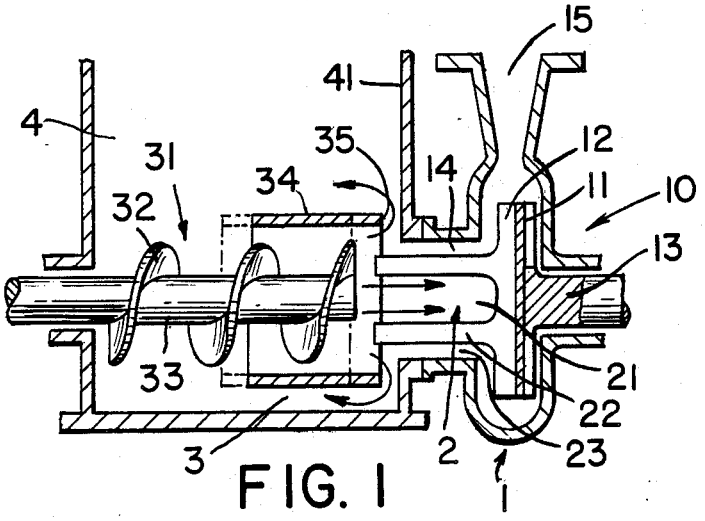
FIG. 1 is a schematic cross-sectional illustration of a first embodiment of the invention.

According to FIG. 1 an apparatus for pumping fiber suspension of high consistency comprises three sub units: a pump 1, a fluidizing element 2 and a feeder apparatus 3. Respectively, the same reference numbers can be used to refer to the three operational zones: pumping zone, fluidizing zone and feeding zone. The pumping zone 1 includes a centrifugal pump 10, an impeller 11 of the centrifugal pump, vanes 12 of the impeller, a shaft 13 and an inlet opening 14 as well as an outlet opening 15 for fiber suspension. The fluidizing zone 1 includes a rotor 21, blades 22 of the rotor, which rotate in a duct 23, which communicates also with the inlet opening 14 for fiber suspension. In the example of FIG. 1 the blades 22 of the rotor 21 extend throughout the duct 23 to the feeding zone 3 of fiber suspension.

The feeding zone 3 includes a feeding member 31, which can be, for example, a screw feeder, the thread/threads 32 of which are located on the shaft 33. In the embodiment of the drawing the diameter of the screw feeder 31 is considerably greater than the diameter of the duct 23. The feeder screw is, however, advantageously located on the same axial line as the pump 10, although on the other hand in some cases the screw can also be located either slightly aside from the axial line or even in a suitable angle position with it. The feeding zone also includes a housing cylinder 34, which in the embodiment of FIG. 1 surrounds like a tube the screw feeder 31. The housing cylinder 34 is movable in the axial direction of the feeder member 31 operating as a control element of the feed pressure to the fiber suspension being fed to the fluidizing zone. The closer the front end 35 of the housing cylinder is to the wall 41 of mass tower 4 or like vessel, the higher the pressure is in the fluidizing zone. Note in FIG. 1 the adjusted or axially displaced position of housing cylinder 34, shown in dashed lines. In any case some kind of clearance is to be maintained between the wall 41 and the front end 35, while the screw feeder 31 is advantageously dimensioned to greater capacity than the maximum production of the pump 10. Thus the movable housing cylinder 34 allows the excess fiber suspension discharge from said clearance back to the mass tower 4. The back-circulation of fiber suspension facilitates also the feed of fiber suspension flowing to the screw by keeping the fiber suspension in a transverse movement. The housing cylinder can be supported to be axially movable, for example, on the bottom of the mass tower or on rails on the side walls. The actual transfer can take place either manually or by suitable automatic guidance by means of hydraulic, pneumatic or electric equipment (not shown).

As one alternative or modification to the embodiment of FIG. 1 an arrangement can be disclosed, in which the movable housing cylinder 34 is replaced by a cylindrical chamber defined by a suitably curved bottom of the mass tower and a curved plate above the feeder member being axially movable relative to the feeder member.

Figure 2:
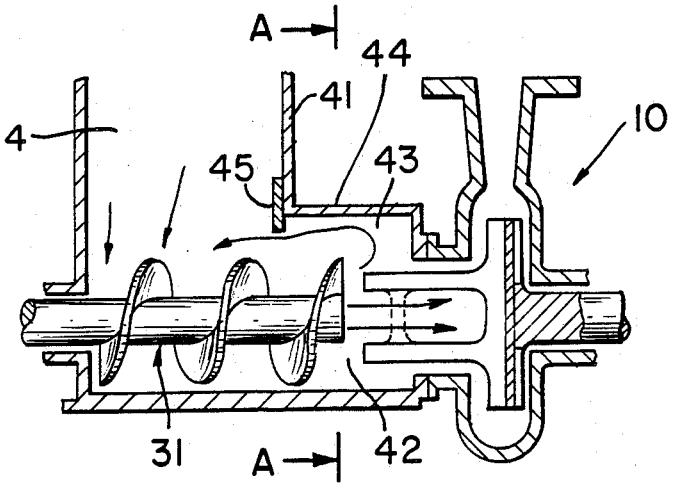
FIG. 2 is a schematic cross-sectional illustration of a second embodiment of the invention.
Figure 2A:
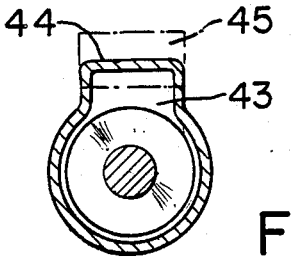
FIG. 2A is a sectional view of taken along A—A of FIG. 2.

A second embodiment is shown in FIG. 2, in which the housing cylinder is replaced by a protruding chamber 42 provided in the wall 41 of the mass tower 4, through which chamber the feeder member 31 feeds fiber suspension to the pump 10. In said embodiment the feeder member 31 is located in close proximity of the bottom of the mass tower 4, but leaving a considerable clearance 43 above it between the upper surface 44 of the chamber 42 and the feeder member 31. Thus the back-circulation of the fiber suspension of the fed excess fiber suspension is carried out through said clearance and by constricting this duct with control devices 45, e.g. with a vertically and adjustably displaceable plate, it is possible to control the feed pressure.

Figure 3:
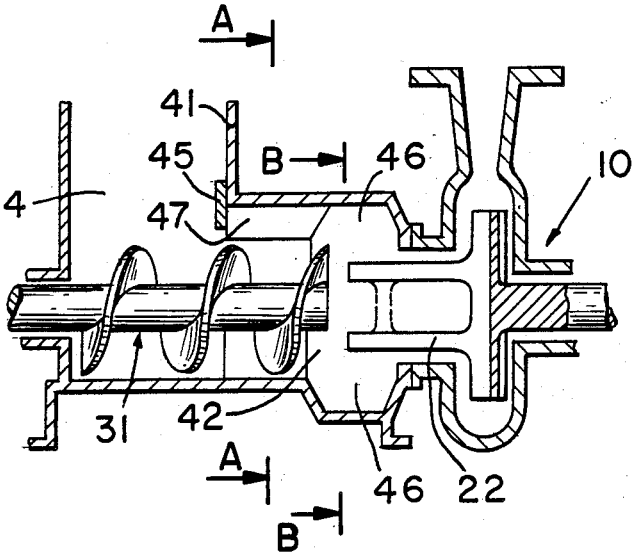
FIG. 3 is a schematic illustration of a third embodiment of the invention.
Figure 3A:
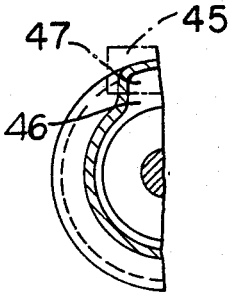
FIG. 3A is a sectional view taken along line A—A of FIG. 3
Figure 3B:
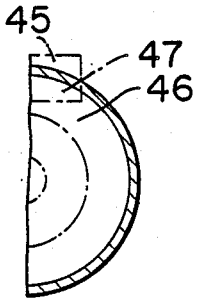
FIG. 3B is a sectional view taken along B—B of FIG. 3

A third embodiment FIG. 3 shows an equipment arrangement, in which the protruding chamber 42 in the wall 41 on the side of the mass tower 4 extends at its outer end to the pump side, whereby the extension part 46 operates partly as a turbulence chamber. Because, however, in this case also the feed of the screw feeder is dimensioned according to the maximum capacity of the pump, the back-circulation is arranged from the extension part 46 through a duct 47, the flow of which can be constricted by adjustable control member 45 in the way and on the basis described above. The operation of the extension part as a turbulence chamber facilitates to some extent the fluidization, subjecting fiber suspension to shear forces and bringing about additional turbulence. As a result pulp flocks and sheets disperse (a kind of pulpering).

Figure 4:
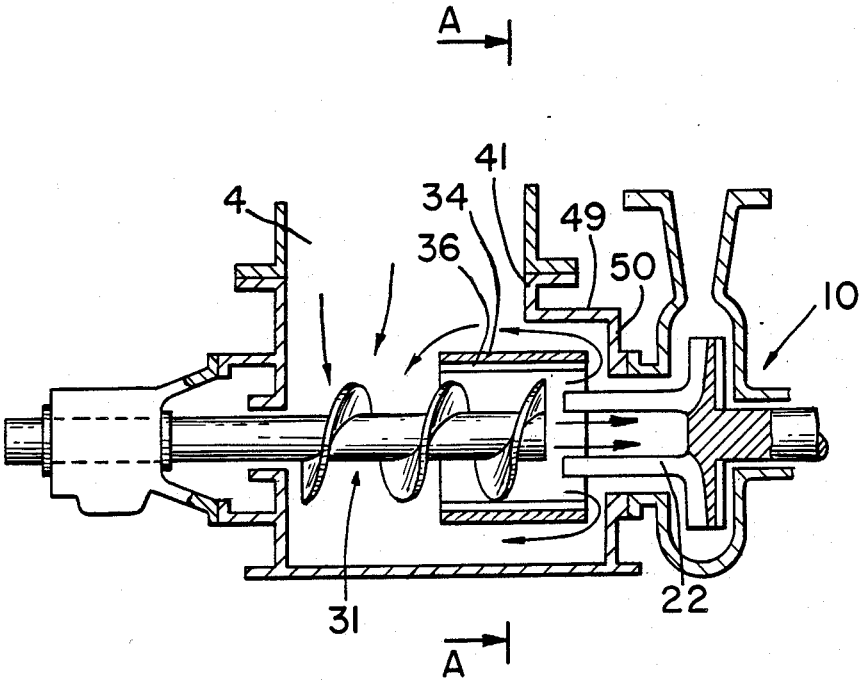
FIG. 4 is a schematic illustration of a fourth embodiment of the invention.
Figure 4A:
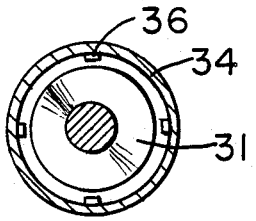
FIG. 4A is a sectional view taken along A—A of FIG. 4.

FIG. 4 discloses yet another equipment arrangement, in which the pump 10 is located in communication with the protruding chamber 49 in the side wall 41 of the mass tower 4. It differs from the embodiment of FIG. 2 in such a way that the protruding chamber 49 is so large that movable housing cylinder 34 is used as a control element of the back-circulation of the fiber suspension in the same way as in FIG. 1. There can be axial bars 36 on the inner surface of the housing cylinder 34, which prevent the rotation of the fiber suspension with the screw operating as a feeder member. Additionally, as it is to be seen in the drawing, it is possible to arrange the whole pumping unit to be removable from under the mass tower 4 as one unit, whereby the exchange of the pump is fast. Furthermore, in the arrangement according to the drawing the fluidizer maintains the throttling opening clear.

Figure 5:
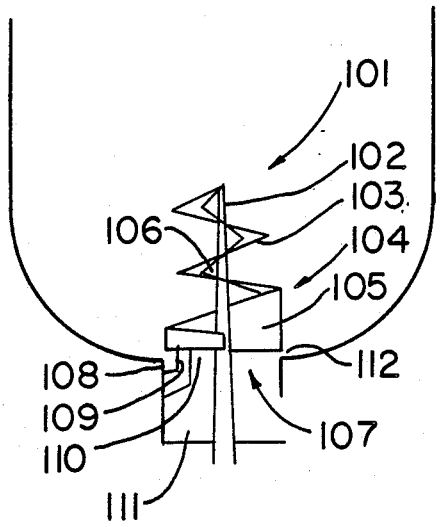
FIG. 5 is a schematic illustration of fifth embodiment of the invention.

A screw feeder apparatus 101 disclosed in FIG. 5 comprises a shaft 102, a thread 103 arranged on it and a closing member 105 mounted on the outer rim of the part 104 of the screw 101, which member at least partially closes the thread in the radial direction. The thread 103 can be, as shown in the drawing, partly open, in other words there is an opening 106 between the shaft 102 and the thread 103 or the thread can be completely closed. The intended use determines which of the construction alternatives is used. The feeder apparatus operates in such a way that the outwards open part of the screw conveys material down towards the end 104 of the screw being closed in the outer rim. When the material to be fed reaches the closed part 104 the diameter of the screw 101 does not change in the case of FIG. 5 and the material flows to the closed part. The closing member 105 forms either a radially closed cylindrical or spiral chamber, in which the material flows axially on. As it is to be seen in FIG. 5, a chamber 107 is formed inside the closing member 105, to which chamber a member 109 extends from the wall 108. The purpose of member 109 is to prevent the material from rotating with the screw.

The opening 110 in the wall 108 can be smaller, equally large or larger in size than the diameter of the part 104 of the screw feeder 101 being closed in the outer rim. For example, a centrifugal pump or a corresponding apparatus requiring feed pressure can be connected to the opening 110 or to the chamber 111 connected to it. The amount of the rise in pressure in the case of the embodiment of the drawing is determined by the relation of the volumetric flow of the screw feeder apparatus 101 to the opening 110 or to the volumetric flow of the apparatus arranged in the chamber connected to the opening 110, and the clearance 112 between the closing member 105 and the wall 109 or the rim of the opening 110. The screw pitch may reduce, i.e. the thread become denser in part 104 or it may remain constant through the whole length of the screw. The closing member may also form in addition to a cylindrical or spiral chamber a conical or even a spherical chamber, which extends towards the discharge end of the screw.

Figure 6:
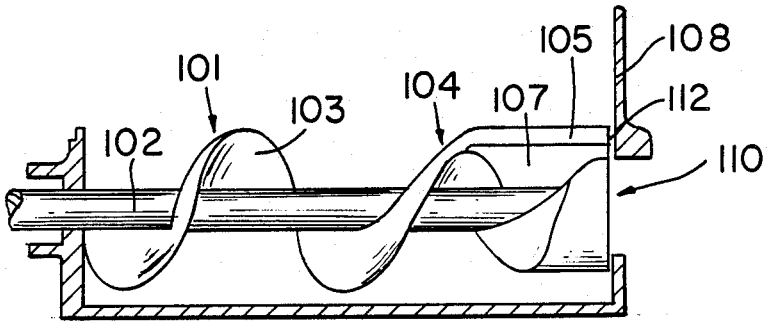
FIG. 6 is a schematic illustration of a sixth embodiment of the invention.

An arrangement is disclosed as a sixth embodiment in FIG. 6, in which the screw feeder apparatus 101 is in a lateral position and corresponds in construction the previous embodiment except for the fact that the use of the screw is arranged from the end of the screw being open in the outer rim, whereby the shaft 102 of the screw 101 can end before the end edge of the closing member 105. Thereby a completely open chamber remains inside the closing member, which chamber can substantially be of form either cylindrical, spiral or conical as it was mentioned above in connection with the previous embodiment. It is advantageous to arrange, for example, a rotor of a fluidizing centrifugal pump to extend to this said chamber, which rotor rotates with higher speed and in different direction from the screw feeder apparatus thus preventing at the same time the liquid to be pumped from rotating with the screw, and helping at the feeding process. In such a case the pressure of the closed chamber is sufficient for the suction pressure of the fluidizing pump and the fluidization process is extremely efficient, because it takes place in a small space. Consequently, it is not necessary to have a high fluidization intensity, because the fluidizing effect can be directed extremely accurately only to the material amount being pumped, and no additional material is redundantly fluidized.

As was already shown at the beginning, it is possible that the closing member does not close the outer rim of the thread completely, but leaves a little gap, for example, at the rear edge of the thread, through which the excess material can flow off. The size of the gap is yet to be defined in such a way that the pressure can not totally be discharged through the gap, but only to desired extent. By using this kind of closing member it is possible to mount the screw feeder apparatus so tightly either against the wall 108 or against the edges of the opening 110 that hardly any material can flow off through the clearance between said elements.

As it has been stated in the above text, it has been possible to develop an extremely simple and reliable method and apparatus for different purposes, in which rise of pressure is needed when feeding in material. Thus, for example, methods and apparatuses of different pumps and refiners may come into question. Despite the simplicity of the method of the invention and the screw feeder apparatus realizing it, they are applicable with the treatment of extremely many tyes of material. Materials to be conveyed can be different types of sewage sludges, granular material, such as chips and grains, as well as fiber suspensions of different consistencies in the pulp and paper industry among others. Thus it is to be noted that the description above introduces only by means of example preferred embodiments of the invention and no unnecessary limitations of the scope of invention should be understood therefrom departing from what is given in the accompanying claims.

Therefore it is obvious that the above described screw feeder apparatus may either be in communication with the same shaft as the pump or it may operate as an independent separate unit. The operating speed of the screw feeder may vary considerably, for example the following combination is possible: screw feeder 400 rpm, pump/fluidizing rotor 3000 rpm. The rotational direction of the screw may also vary relative to the rotational direction of the pump. Furthermore, it is possible to provide the screw with several threads and the outer edges of the thread/threads with toothing so as to break up the fiber flocks.

Similarly, the control members may differ considerably from what is described above. For example, a conventional valve may, of course, operate as a control member. In addition, the position of the fluidizing rotor of the pump relative to the feeder apparatus and the suction duct of the pump may also vary. The rotor may extend through the suction duct to the mass tower chamber, but respectively also any part of the feeder apparatus, e.g. the head part of the screw thread, may extend to the suction duct. It is also possible to use the arrangement according to the invention together with other types of pumps. Likewise the invention may be applied to the discharge of the mass towers or like vessels or containers means, whereby the pump may be completely left out and only the feeder apparatus and the fluidizing rotor be used.

I claim:

1. A method of pumping high-consistency fiber suspension using a centrifugal pump, comprising the steps of forming a feeding zone for removing fiber suspension from a source, feeding the fiber suspension directly from the feeding zone to a fluidizing zone, fluidizing the fiber suspension within the fluidizing zone and feeding the fluidized fiber suspension directly into a pumping zone containing the centrifugal pump, withdrawing a portion of the fiber suspension flowing from the feeding zone to the fluidizing zone and returning the withdrawn portion for recirculation to the feeding zone and throttling the fluid suspension flow from the feeding zone to the fluidizing zone for establishing the feed pressure of the fiber suspension to the pumping zone.

2. A method, as set forth in claim 1, including variably throttling the fluid suspension in withdrawing the portion of the fluid suspension flowing to the fluidizing zone.

3. A method, as set forth in claim 1, wherein throttling the fiber suspension being withdrawn by locating control members in the path of the fiber suspension flowing from the feeding zone to the fluidizing zone.

4. An apparatus for pumping high-consistency fiber suspension comprising a centrifugal pump located within a housing having an inlet and an outlet, an impeller rotatably mounted within said housing, a fluidizing rotor located upstream from said impeller within said inlet, feed means for feeding fiber suspension to said rotor in said inlet, said inlet having an entrance for receiving the fiber suspension from said feed means, means located in the flow path of the fiber suspension from said feed means to the entrance of said inlet for withdrawing the fiber suspension, and returning at least a portion of the fiber suspension to said feed means.

5. An apparatus, as set forth in claim 4, wherein said means for withdrawing fiber suspension includes a tubular throttle device for controlling the withdrawal of the fiber suspension.

6. An apparatus, as set forth in claim 5, wherein said means for withdrawing fiber suspension includes a plate-like throttle device for controlling the withdrawal of the fiber suspension.

7. An apparatus, as set forth in claim 4, wherein said means for withdrawing fiber suspension comprises a throttle device, said throttle device comprises a housing cylinder located adjacent the entrance of said inlet for providing an opening having a cross-sectional area for the withdrawal of fiber suspension.

8. An apparatus, as set forth in claim 4, wherein said means for withdrwing fiber suspension comprises a throttle device having at least one control member arranged in the path of the withdrawn fiber suspension adjacent the entrance to said inlet.

9. An apparatus, as set forth in one of claims 5, 6, 7, or 8, wherein said throttle device is adjustable.

10. An apparatus, as set forth in claim 4, wherein said means for withdrawing fiber suspension comprises a throttle device, said throttlel devices comprises a housing cylinder laterally enclosing a screw feeder forming said feed means, said screw feeder has an axial direction and said housing cylinder being displaceable in the axial direction of said feeder.

* * * * *